US005226541A

United States Patent [19]

Huang

[11] Patent Number: 5,226,541

[45] Date of Patent: Jul. 13, 1993

[54] MULTI-FUNCTIONAL KNOCK-DOWN TYPE MAKE-UP KIT

[76] Inventor: Hui C. Huang, 5F-23, 70, Fu-Shing Road, Taoyuan, Taiwan

[21] Appl. No.: 846,573

[22] Filed: Mar. 5, 1992

[51] Int. Cl.[5] ..... B65D 69/00

[52] U.S. Cl. ..... 206/581; 206/86; 206/823; 132/294; 132/314

[58] Field of Search ..... 206/38, 235, 86, 581, 206/823; 132/294, 297, 301, 304, 314, 317, 318

[56] References Cited

U.S. PATENT DOCUMENTS

| | | | |
|---|---|---|---|
| 1,639,628 | 8/1927 | Bass | 206/38 |
| 2,010,521 | 8/1935 | Kreisler | 206/38 |
| 2,039,205 | 4/1936 | Anderl | 206/235 |
| 2,512,476 | 6/1950 | Birnkrant et al. | 206/235 |
| 2,573,620 | 10/1951 | Spitalny | 206/235 |
| 3,502,089 | 3/1970 | Paradis | 132/294 |
| 4,331,239 | 5/1982 | Ortal | 206/581 |
| 4,555,020 | 11/1985 | Campello et al. | 206/38 |
| 4,666,043 | 5/1987 | Tahara | 206/38 |
| 4,858,765 | 8/1989 | Nakamura et al. | 206/581 |
| 4,936,463 | 6/1990 | Tiramani | 206/235 |

*Primary Examiner*—David T. Fidei
*Attorney, Agent, or Firm*—Bacon & Thomas

[57] ABSTRACT

A make-up kit is composed of plural storage and functional components which may be alternatively and detachably assembled together through cooperating male and female slip joints to adapt the kit to the personal needs of the user.

4 Claims, 4 Drawing Sheets

MULTI-FUNCTIONAL KNOCK-DOWN TYPE MAKE-UP KIT

BACKGROUND OF THE INVENTION (1) Field of the Invention

The present invention relates to a multi-functional knock-down type make-up kit, particularly a make-up kit with a plurality of compartments or spaces for storing a mirror, eye shadow cream, brush, blush, and so forth. The kit formed by combining a number of components through connections by male and female slip joints, and incorporated with a lipstick and a lighter.

(2) Description of the Prior Art

Generally each beauty product is packed in a container in the form of a circular case, and a number of cases are used for different beauty products. Therefore, it is not convenient to carry them, and it does not meet the compact and practical requirements being emphasized by women today. Moreover, different women have different requirements in different environments, and since a conventional case for packing a beauty product is designed for a fixed purpose, it does not provide extra spaces to hold other articles, such as an ear ring, finger ring, etc.

In view of the above inconvenience, the inventor has created a multi-functional knock-down type make-up kit to provide compartments for holding a variety of cosmetic products. It is a compact, beautiful and useful invention and permits different cosmetic products to be available for use in different environments.

SUMMARY OF THE INVENTION

The present invention relates to a multi-functional knock-down type make-up kit comprising a body having a plurality of compartments, a semi-cylindrical upper cover, a plurality of drawers held by openings at a side, and a female slip joint at the bottom to incorporate a lipstick and/or lighter designed with corresponding male slip joints. It can be enlarged to an appropriate size for use as a stationery holder as well.

The main objective of the present invention is to provide a compact and useful multi-functional knock-down type make-up kit with a plurality of compartments and drawers to provide space for holding a variety of cosmetic products.

Another objective of the present invention is to provide a multi-functional knock-down type make-up kit with its components assembled together by engagement between male and female slip joints, and incorporated with a lipstick and a lighter.

Another objective of the present invention is to provide a multi-functional knock-down type make-up kit with independent components which can be carried separately.

Another objective of the present invention is to provide a multi-functional knock-down type make-up kit with a plurality of compartments and drawers to hold cosmetic products or to provide a stationary kit if enlarged to an appropriate size.

DETAILED DESCRIPTION OF THE PREFERRED EMBODIMENTS

Figure 2:
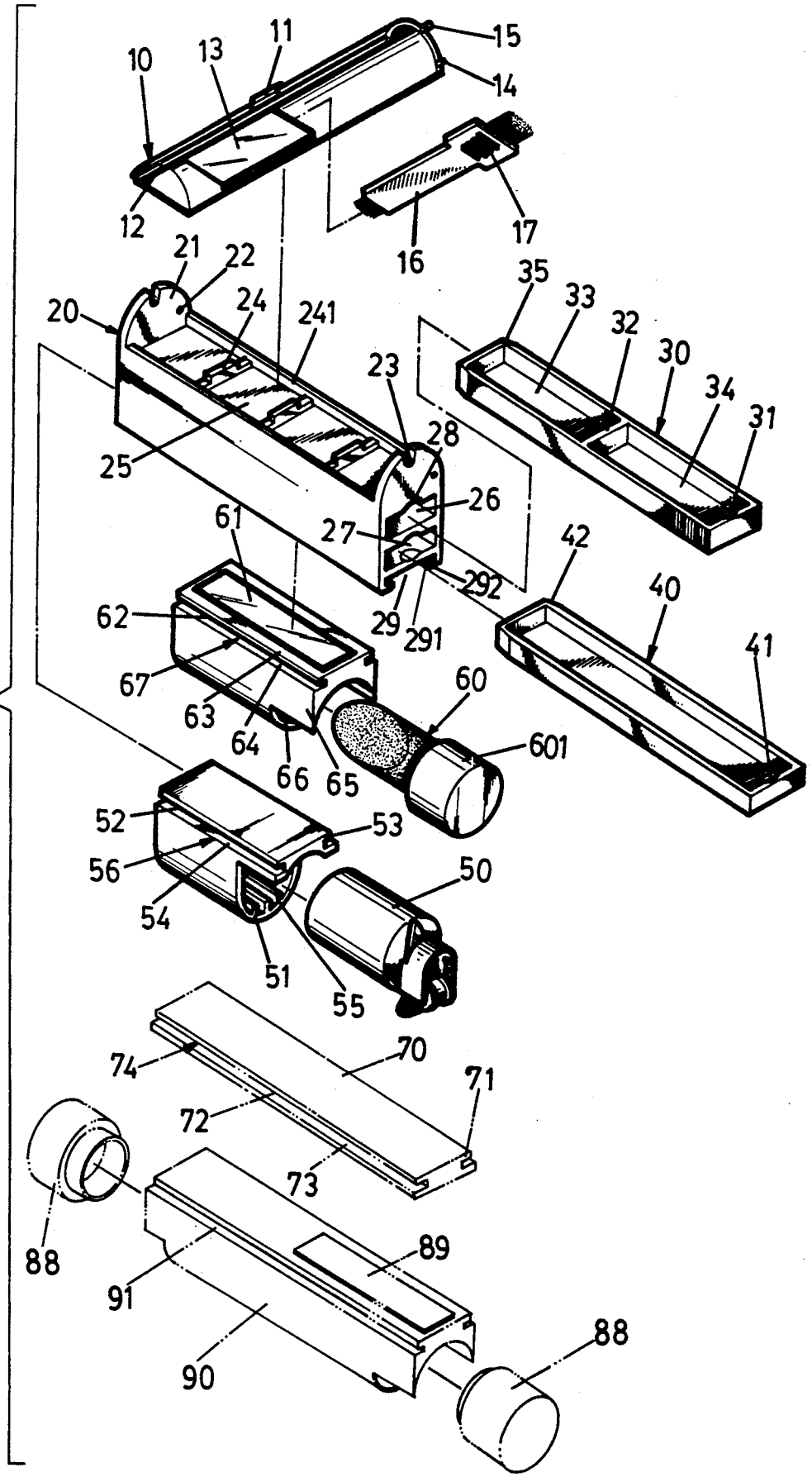
FIG. 2 is an exploded perspective view of the make-up kit according to the first embodiment.

As shown in FIG. 2, the make-up kit according to the present invention has an upper cover (10) in the form of a substantially semi-cylindrical shell with an elongate retaining rib (12) formed along the lower edge of its front side, a pivot shaft (14) in the form of a post at each end of its rear side, and a retaining column (15) in the middle of each end. A tenon (11) is formed at the middle of the retaining element (12). A rib portion (18) is formed on the inner surface at each side of the upper cover (10) for attachment of a mirror (13).

A brush (16) is designed with different brushes at both ends and a handle with different sections of different widths. A knurled portion (17) is formed on the widest section of the handle.

The make-up kit includes a body (20) having a semi-circular side board (21) at the top of each end. A pin hole (22) is formed on the inner side of each side board (21), and a semi-circular retaining slot (23) is formed on the top of each side board (21) corresponding to each retaining column (15) of the upper cover (10). Stepped rails (24) are designed on the top of the body (20) and frame members (241) are formed at the front and rear sides of the body (20) respectively to provide a plurality of compartments (25) in the body (20). The front frame member (241) is provided with a retaining groove for engagement by rib (12). On a side of the body (20), an upper slot (26) and a lower slot (27) are each formed with mortises (28) at each side of each slot (26 or 27). The body (20) has a pair of opposed inwardly directed connecting ribs (292) at the bottom to collectively form a channel (291) that serves as a pair of female slip joints (29).

In this embodiment, two drawers (30 and 40) are used. The drawer (30) is incorporated with a partitioning wall (32) to form two separated spaces (33 and 34). The drawer (30) is designed with a mortise (31) at the front end, and a chamfered edge (35) at each side of its rear end. The other drawer (40) is a rectangular hollow box with a chamfered edge (42) at each side of its rear end and a mortise (41) at its front end.

A lipstick (60) includes a stick portion (601) in substantially the form of a cylinder corresponding to a sleeve (66) having a flat top surface for attachment of a mirror. The sleeve (66) is formed with sliding rails (63) at two opposite sides of the top surface so as to form a ribbed channel (62) between each sliding rail (63) and a stepped face (64). The sliding rail (63), ribbed channel (62) and stepped face (64) form a male slip joint (67). On the top of the sleeve (66), a section is formed as a semi-cylindrical handle (65).

A lighter (50) with a lighter holder (51) is used in this embodiment. The lighter holder (51) has a flat top surface, and is formed with sliding rails (53) at two opposite sides of the top surface so as to form a ribbed channel (52) between each sliding rail (53) and a stepped face (54). The sliding rail (53), ribbed channel (52) and stepped face (54) form a male slip joint (56). On the inner surface of the lighter holder, a plurality of ribs (55) are formed.

An insert plate (70) in the form of a long plate with sliding rails (71) on its two opposite upper and lower edges and a flat top surface (73) is designed for the present invention. It has a male slip joint (74) formed by a ribbed channel (72) at each lateral side.

A case (90) is substantially in the form of lipstick (60). A male slip joint (91) is formed at each of its lateral sides and a mirror (89) is attached on its top surface. A plug (88) is used to close each open end of case (90).

Figure 1:
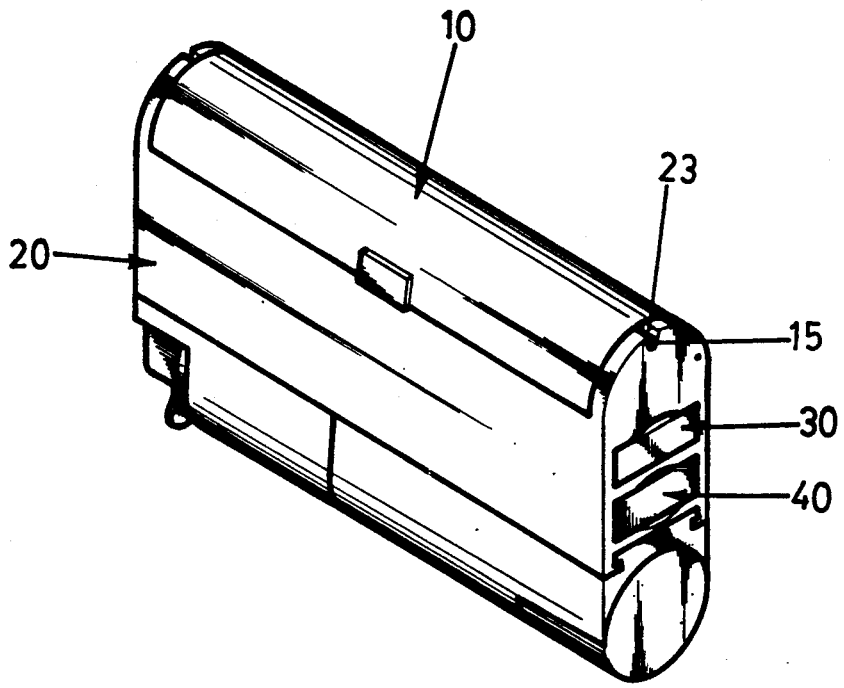
FIG. 1 is a perspective view of a make-up kit according to a first embodiment of the present invention.

Please refer to FIG. 1, for assembly of the present invention, the upper cover (10) is pivotally fitted to the body (20) by inserting a pivot shaft (14) at each end of the upper cover (10) into a pin hole (22) an each side board (21) of the body (20), engaging the retaining rib (12) to the grooved frame element (241) at the front side of the body (20), and engaging the retaining columns (15) to the retaining slots (23) on the body (20).

The brush (16) is placed within body (20) below the inner mirror (13) in the upper cover (10), and can be removed easily by holding the knurled portion (17) on the handle of the brush (16).

The drawers (30 and 40) are inserted through the slots (26 and 27) respectively. The lighter (50) and the lipstick (60) are fixed to the body (20) by engaging their respective male slip joints (56 and 67) to the female slip joints (29). Alternatively, the insert plate (70) or case (90), instead of the lighter (50) and the lipstick (60), can be fixed to the body (20) by engaging its male slip joints (74) or (91), respectively, to the female slip joints (29) to form a simplified kit, as the lighter (50) can be replaced by another lipstick to form a kit with two lipsticks.

Figure 5:
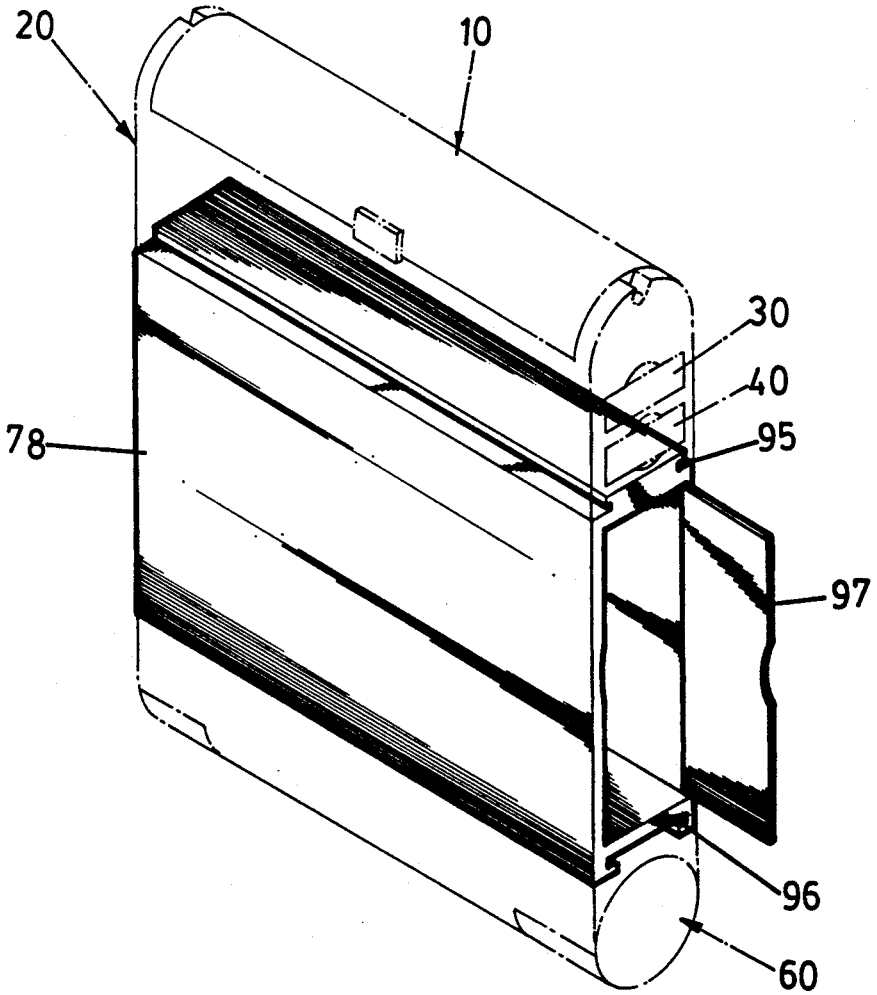
FIG. 5 illustrates a perspective view of a third embodiment of the present invention.

Please refer to FIG. 5, a container (78) can be placed between the body (20) and the lipstick (60). The container (78) is designed with two male slip joints (95) on the top, two female slip joints (96) at the bottom, and a pull-down type cover (97) on a side.

Figure 3:
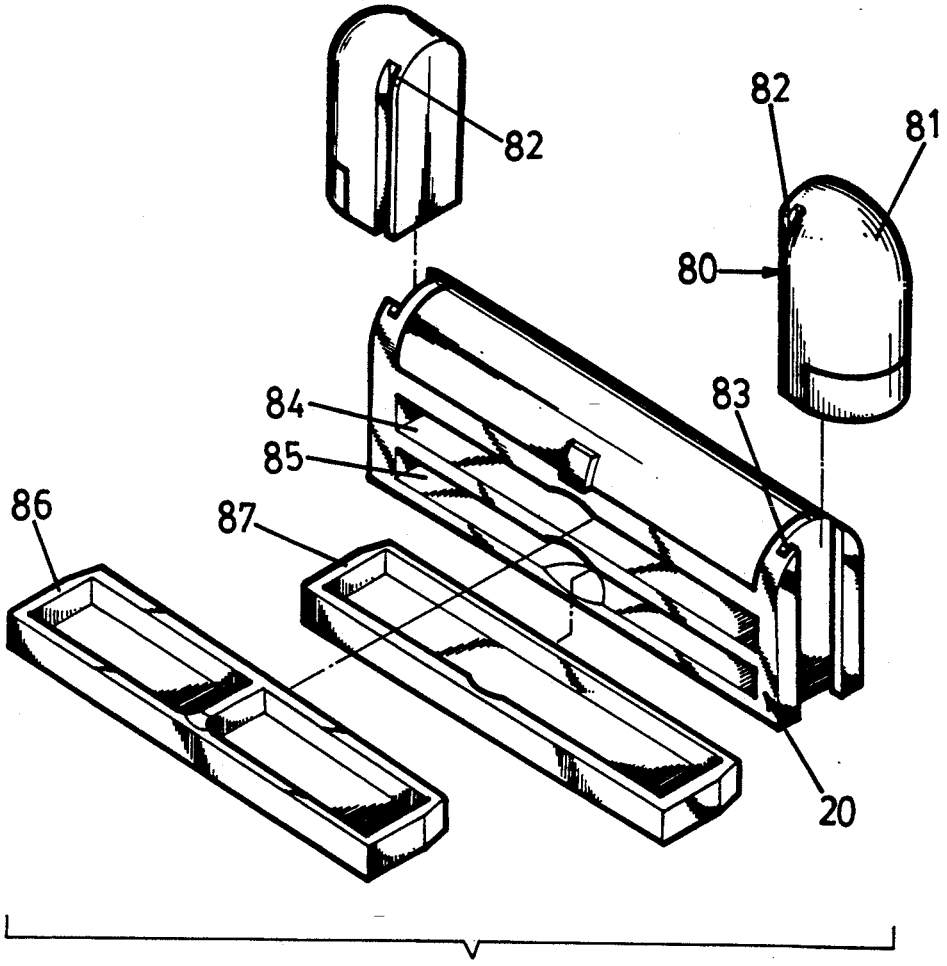
FIG. 3 is an exploded perspective view of a second embodiment of the present invention.

Please refer to FIG. 3 for another embodiment of the present invention. A lipstick (80) having a dome-like shell (81) and two male slip joints (82) on two opposite sides is fixed to each end of the body (20) designed with a pair of female slip joints (83) corresponding to the male slip joints (82), and two drawers (86 and 87) are placed in two slots (84 and 85) at the front side of the body (20).

Figure 4:
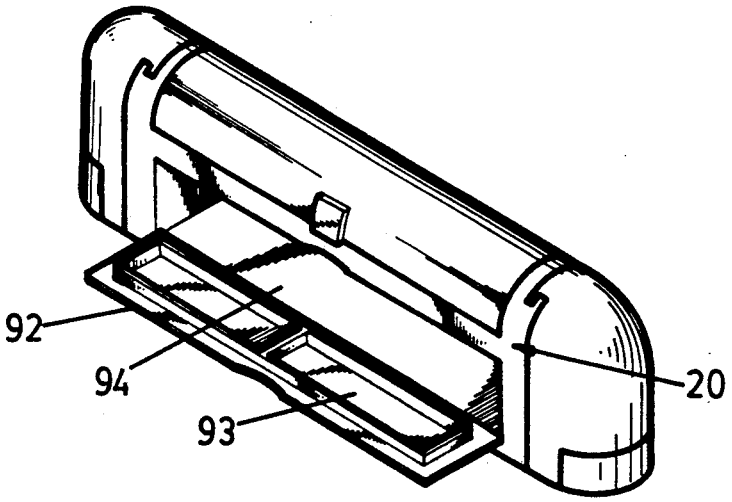
FIG. 4 is a perspective view of the second embodiment.

Please refer to FIG. 4 for a further embodiment of the present invention, wherein a pull-down type cover (92) is provided on the side of the body (20), and a plurality of compartments (93) are formed inside the cover (92) so that the body (20) defines a container (94).

As described above, the multi-functional knock-down type make-up kit is a design with a plurality of compartments and drawers which may be assembled in different ways, and slip joints are used to facilitate such assembly. It serves to provide a free arrangement of space for different purposes, and is a useful structure.

What is claimed is:

1. A multi-functional knock-down type make-up kit comprising:

a) a main body having a top and a bottom, and including a pair of semi-circular boards at opposed ends of the top, a plurality of drawers slidably received in the main body, each drawer including at least one storage compartment therein, a plurality of stepped rails and a pair of opposed front and rear frame members forming a plurality of compartments at the top, and a pair of connecting ribs at the bottom defining a female slip joint;

b) a substantially semi-cylindrical cover, means securing the cover to the top of the main body for pivotal movement between open and closed positions, means retaining the cover to the body in the closed position, and a tenon provided at a front middle portion of the cover;

c) a first holder body for receiving a lipstick therein and including a cylindrical-shaped sleeve, a flat top portion, a pair of rails at opposite sides of the top portion defining a first male slip joint, and a semi-cylindrical handle on a top section of the sleeve;

d) a second holder body for receiving a lighter and including a compartment provided with an inner surface, a plurality of ribs on the inner surface, a flat top portion, and a pair of rails at opposite sides of the top portion defining a second male slip joint;

e) an insert plate including a pair of rails at opposite sides thereof defining a third male slip joint; and f) wherein either the first and second holder bodies may be detachably secured to the main body by engaging the first and second male slip joints with the female slip joint or the insert plate may be detachably secured to the main body by engaging the third male slip joint with the female slip joint.

2. The make-up kit of claim 1 wherein:

a) the means for pivotally securing the cover to the main body includes a pair of pin holes provided in the side boards and a pair of pivot shafts provided on the cover for engaging the pin holes; and b) the retaining means includes a pair of retaining slots formed in the side boards and a pair of retaining columns provided on the cover for engaging the retaining slots.

3. The make-up kit of claim 1 further including:

a) a mirror provided on an inner surface of the cover;

b) a mirror provided on the top portion of the first holder body; and c) a brush including separate and different brush heads at both ends thereof, a handle formed with plural sections of different widths, and a narrowed portion formed on a wider section of the handle for inserting the handle into and removing the handle from the top of the main body.

4. The make-up kit of claim 1 further including a container having a top portion and a bottom portion, a pivotal cover positioned between the top and bottom portions for opening and closing the container, a pair of rails at opposite sides of the top portion defining a male slip joint, a pair of connecting ribs at the bottom portion defining a female slip joint, wherein the male slip joint may be detachably secured to the female slip joint of the main body and the first and second male joints of the holder bodies may be detachably secured with the female slip joint of the container.

* * * * *